United States Patent [19]

Oppenlaender et al.

[11] Patent Number: 4,657,560

[45] Date of Patent: Apr. 14, 1987

[54] AQUEOUS COAL DISPERSIONS

[75] Inventors: Knut Oppenlaender, Ludwigshafen; Karl Stork, Lampertheim; Friedrich Hovemann, Hockenheim; Erich Schwartz, Ludwigshafen, all of Fed. Rep. of Germany

[73] Assignee: BASF Aktiengesellschaft, Ludwigshafen, Fed. Rep. of Germany

[21] Appl. No.: 781,888

[22] Filed: Sep. 30, 1985

[30] Foreign Application Priority Data

Sep. 29, 1984 [DE] Fed. Rep. of Germany ..... 3435945

[51] Int. Cl.[4] ..... C10L 1/32

[52] U.S. Cl. ..... 44/51; 44/53; 44/77

[58] Field of Search ..... 44/51, 53, 77

[56] References Cited

U.S. PATENT DOCUMENTS

| | | | |
|---|---|---|---|
| 4,242,098 | 12/1980 | Braun et al. | 44/51 |
| 4,302,212 | 11/1981 | Yamamura et al. | 44/51 |
| 4,358,293 | 11/1982 | Mark | 44/51 |

FOREIGN PATENT DOCUMENTS

| | | | |
|---|---|---|---|
| EP/0077909 | 5/1983 | European Pat. Off. . | |
| 1644942 | 8/1977 | Fed. Rep. of Germany . | |
| WO83/00005-00 | 2/1983 | Int'l Pat. Institute . | |
| 58-0049794 | 3/1983 | Japan | 44/51 |
| 58-0045729 | 3/1983 | Japan | 44/51 |
| 58-0176294 | 10/1983 | Japan | 44/51 |
| 59-0043095 | 3/1984 | Japan | 44/51 |
| 59-0038288 | 3/1984 | Japan | 44/51 |
| 83/04047 | 11/1983 | PCT Int'l Appl. . | |
| 83/04044 | 11/1983 | PCT Int'l Appl. . | |

*Primary Examiner*—William R. Dixon, Jr.
*Assistant Examiner*—Margaret B. Medley
*Attorney, Agent, or Firm*—Oblon, Fisher, Spivak, McClelland & Maier

[57] ABSTRACT

Aqueous, pumpable, free-flowing coal dispersions which may contain methanol and contain a special, oxyethylated, straight-chain, saturated fatty alcohol mixture as a nonionic dispersant, and the use of this dispersant in coal/water dispersions.

8 Claims, No Drawings

AQUEOUS COAL DISPERSIONS

The present invention relates to aqueous, pumpable, free-flowing coal dispersions which may or may not contain methanol and contain a special, oxyethylated, straight-chain, saturated fatty alcohol mixture as a monionic dispersant, and the use of these dispersants in coal/water dispersions.

Aqueous coal dispersions have recently become increasingly important, particularly because of the possibilities of transporting them advantageously, for example in pipelines.

U.S. Pat. No. 4,358,293 discloses aqueous coal dispersions which contain fairly high molecular weight polyalkylene oxides as nonionic surfactants. Polyalkylene oxides of alkylphenols, such as nonylphenoxypolyethylene oxide containing more than 100 ethylene oxide units, are among the substances described.

It has been found that the various surfactants are not particularly suitable in all cases, ie. they cannot be used for all types of coal. Moreover, some of the dispersants used to data are difficult to handle since they may dissolve very slowly in water, and in some cases concentrated aqueous solutions cannot be prepared.

PCT Applications WO 83/04044 and WO 83/04047 disclose generally oxyethylated aliphatic alcohols of 10 to 24 carbon atoms and containing from 40 to 200 ethylene oxide (EO) units for the preparation of aqueous coal dispersions. For the preferred alcohols of 10 to 24 carbon atoms, from 40 to 100 EO units or a ratio of EO units to number of carbon atoms of from 3.5 to 6.0, ie. about 150 EO units, are preferred. In this case too, however, the solution described is not always adequate in practice: a particular disadvantage is the excessively high viscosity of the coal dispersions prepared using the solution.

It is an object of the present invention to provide novel dispersants for coal dispersions containing various types of coal.

We have found that this object is achieved, and that special, oxyethylated, straight-chain, saturated primary fatty alcohol mixtures are very useful as dispersants for aqueous coal dispersions.

The present invention accordingly relates to aqueous, pumpable, free-flowing coal dispersions containing from 65 to 80% by weight of ground coal, from 35 to 20% by weight of water, of which from 1 to 60% by weight can be replaced by methanol, and conventional additives, the percentages in each case being based on the total weight, wherein the dispersion contains, as a nonionic dispersant, from 0.1 to 1.5% by weight, based on the total weight of the mixture, of an oxyethylation product of a mixture of straight-chain, saturated primary fatty alcohols consisting of:

from 0.1 to 2.0% by weight of a $C_{12}$-alcohol,
from 3.0 to 6.0% by weight of a $C_{14}$-alcohol,
from 20.0 to 35.0% by weight of a $C_{16}$-alcohol,
from 55.0 to 75.0% by weight of a $C_{18}$-alcohol and
from 0.5 to 3.0% by weight of a $C_{20}$-alcohol, containing from 180 to 230 ethylene oxide units, based on the mean molecular weight of the alcohols, and to the use of this nonionic dispersant in aqueous coal dispersions.

The oxyethylation product of a mixture of straight-chain, saturated primary alcohols consisting of from 0.3 to 0.7% by weight of a $C_{12}$-alcohol, from 3.0 to 5.0% by weight of a $C_{14}$-alcohol, from 25 to 35% by weight of a $C_{16}$-alcohol, from 65 to 70% by weight of a $C_{18}$-alcohol and from 0.5 to 3.0% by weight of a $C_{20}$-alcohol, containing from 190 to 220 ethylene oxide units, is preferred.

In a surprising and unforeseeable manner, the novel mixture has a substantially better effect than the individual oxyethylated saturated fatty alcohols in respect of reducing the viscosity of the coal dispersions prepared with these substances. The optimum found was in no way obvious.

The novel coal dispersions preferably contain a ground flotation coal which has an advantageous particle size distribution of less than 300 μm.

An example of a particularly advantageous distribution is one in which 100% of the particles are smaller than 300 μm, 80% are smaller than 200 μm and 50% are smaller than 50 μm.

Of course, coal having a high ash content is as a rule more difficult to disperse than coal which has a low ash content. A high ash content is about 8–12%, while a low one is less than 4% of ash. The sulfur content of the preferably used flotation coal is as a rule less than 1%.

The pumpability and the free-flow property relate to the viscosity of the coal dispersion. As a rule, a dispersion having a viscosity of 2,000 mPa.s is just free-flowing. In practice, the desired values are 1,000 mPa.s or less, so that transport can be effected with a very small consumption of energy. The optimum range is below 800 mPa.s and is readily achieved with the coal dispersions according to the invention, as shown in the Examples.

As stated above, from 1 to 60% by weight of the water may be replaced with methanol. The addition of methanol serves to reduce the viscosity (increase the pumpability) of the coal dispersions at below 0° C. (eg. down to −20° C.).

The coal dispersions according to the invention also contain the following conventional additives with which the skilled worker is familiar:

Antifoams, for example conventional antifoams such as fatty acid polyoxyalkylates, eg. stearyl alcohol oxypropylate containing from 10 to 50 propylene oxide units or silicone oils, etc.; soluble inorganic salts, eg. ammonium chloride and carbonate, and alkali metal and alkaline earth metal chlorides and carbonates, in particular those of sodium, of calcium and of magnesium, and water-soluble phosphates and silicates, such as sodium hexametaphosphate or sodium metasilicate 9-hydrate, as viscosity regulators; pH regulators, such as alkali metal and alkaline earth metal hydroxides, ammonia and primary and secondary amines, since a pH of from 8 to 10 is particularly advantageous in practice; and stabilizers which act as protective colloids and/or as thickeners, suitable compounds of this type being polyethers (eg. polyethylene oxide, copolymers of polyethylene oxide and polypropylene oxide), carboxymethylcellulose, hydroxyethylcellulose, polysaccharides (eg. alginates), polyalcohols, polyacrylates and copolymers of these. Other conventional additives are biocides.

The preparation of the dispersants used according to the invention is known per se and is carried out by methods which have been described. The degree of oxyethylation is based on the mean molecular weight, which is determined from the hydroxyl number of the mixture.

The novel aqueous coal dispersions are prepared in a conventional manner. As a rule, a concentrated aqueous solution which contains from 40 to 70% by weight of a novel dispersant and, in contrast to some prior dispersants, can readily be prepared is added to an amount of water, to which the ground coal and, if required, further additives are added while stirring.

EXAMPLES

A. Preparation of the novel dispersants

1% by weight of potassium hydroxide was added to the alcohol mixture, and the stirred mixture was reacted, a little at a time, with ethylene oxide at 120°–130° C., the pressure not exceeding 10 bar. The starting material to be oxyethylated had the following composition:
0.5% by weight of lauryl alcohol,
4% by weight of myristyl alcohol,
28% by weight of cetyl alcohol,
66% by weight of stearyl alcohol and
1.5% by weight of eicosyl alcohol.

B. Examples of use

Composition of the coal/water dispersions:
70% by weight of imported Polish coal (ground flotation coal),
0.5% by weight of a dispersant shown in Table I and
29.5% by weight of water.

The dispersant was dissolved in water, and the coal was added in the course of 3 minutes while stirring at about 1,000–3,000 rpm with the aid of a pilot-scale dissolver, and was dispersed for 20 minutes at 6,500 rpm.

The viscosity of the dispersion (mPa.s) was determined using a rotational viscometer at 20° C. and a shear velocity D of 220 $s^{-1}$.

TABLE I

| Examples | Dispersant | Viscosity [mPa.s] of the dispersion according to B |
|---|---|---|
| | I Comparison | |
| 1 | lauryl alcohol.100 EO | not measurable |
| 2 | myristyl alcohol.100 EO | not measurable |
| 3 | myristyl alcohol.150 EO | not measurable |
| 4 | cetyl alcohol.100 EO | not measurable |
| 5 | cetyl alcohol.150 EO | 2,000 |
| 6 | stearyl alcohol.100 EO | not measurable |
| 7 | stearyl alcohol.150 EO | >2,000 |
| 8 | eicosyl alcohol.100 EO | >2,000 |
| 9 | eicosyl alcohol.150 EO | >2,000 |
| 10 | lauryl alcohol.200 EO | not measurable |
| 11 | myristyl alcohol.200 EO | not measurable |
| 12 | cetyl alcohol.200 EO | 1,930 |
| 13 | stearyl alcohol.200 EO | 1,150 |
| 14 | eicosyl alcohol.200 EO | 1,220 |
| | II According to the invention | |
| 15 | mixture according to A.180 EO | 490 |
| 16 | mixture according to A.200 EO | 350 |
| 17 | mixture according to A.210 EO | 380 |
| 18 | mixture according to A.230 EO | 520 |
| | Comparison | |
| 19 | mixture according to A.150 EO | 980 |
| 20 | mixture according to A.100 EO | >2,000 |
| 21 | mixture according to A.250 EO | 1,060 |
| 22 | mixture according to A.300 EO | >2,000 |

In Table I, not measurable denotes a viscosity greater than 20,000. Comparative Examples 1 to 14 correspond to PCT Application WO 83/04044. They are unsuitable for use in practice. Examples 15 to 18 according to the invention are distinguished by superior viscosities. Examples 19 to 22 confirm that the range according to the invention is an optimum one. A lower or higher degree of oxyethylation leads to higher viscosities.

We claim:

1. An aqueous, pumpable, free-flowing coal dispersion containing from 65 to 80% by weight of ground coal, and from 35 to 20% by weight of water, the percentages being based on the total weight, wherein the dispersion contains, as a nonionic dispersant, from 0.1 to 1.5% by weight, based on the total weight of the mixture, of an oxyethylation product of a mixture of straight-chain, saturated primary fatty alcohols which consists of from 0.1 to 2.0% by weight of a $C_{12}$-alcohol, from 3.0 to 6.0% by weight of a $C_{14}$-alcohol, from 20.0 to 35.0% by weight of a $C_{16}$-alcohol, from 55.0 to 75.0% by weight of a $C_{18}$-alcohol and from 0.5 to 3.0% by weight of a $C_{20}$-alcohol, containing from 180 to 230 ethylene oxide units, based on the mean molecular weight of the alcohols.

2. The aqueous coal dispersion as claimed in claim 1, which contains, as the nonionic dispersant, an oxyethylation product of a mixture of straight-chain, saturated primary fatty alcohols which consists of from 0.3 to 0.7% by weight of a $C_{12}$-alcohol, from 3.0 to 5.0% by weight of a $C_{14}$-alcohol, from 25 to 35% by weight of a $C_{16}$-alcohol, from 65 to 70% by weight of a $C_{18}$-alcohol and from 0.5 to 3.0% by weight of a $C_{20}$-alcohol, containing from 190 to 220 ethylene oxide units, based on the mean molecular weight of the alcohols.

3. The aqueous coal dispersion as claimed in claim 1, which contains from 0.2 to 1% by weight, based on the total weight of the mixture, of the nonionic dispersant as claimed in claim 1 or 2.

4. The aqueous coal dispersion as claimed in claim 1, wherein from 1 to 60% by weight of the water is replaced with methanol.

5. The aqueous coal dispersion as claimed in claim 1, wherein said ground coal in said dispersion has a particle size of less than 300 μm.

6. The aqueous coal dispersion as claimed in claim 5, wherein said ground coal in said dispersion has a particle size distribution such that 80% of the particles are smaller than 200 μm and 50% are smaller than 50 μm.

7. The aqueous coal dispersion as claimed in claim 1, wherein said dispersion has a viscosity of about 1,000 mPa or less.

8. The aqueous coal dispersion as claimed in claim 6, wherein said dispersion has a viscosity of 800 mPa or less.

* * * * *